US005190310A

United States Patent [19]

Hauglin et al.

[11] Patent Number: 5,190,310

[45] Date of Patent: Mar. 2, 1993

[54] CROSS-COUNTRY SKI BINDING HAVING A RELEASABLE RETAINING HOOK ASSEMBLY

[75] Inventors: Bernt-Otto Hauglin, Khokkarjtua, Norway; Eugen Popp, Munich, Fed. Rep. of Germany

[73] Assignee: Witco A.S, Norway

[21] Appl. No.: 634,160

[22] PCT Filed: Feb. 19, 1990

[86] PCT No.: PCT/EP90/00084

§ 371 Date: Dec. 12, 1990

§ 102(e) Date: Dec. 12, 1990

[87] PCT Pub. No.: WO90/11806

PCT Pub. Date: Oct. 18, 1990

[30] Foreign Application Priority Data

Apr. 12, 1989 [DE] Fed. Rep. of Germany ... P3912019.8

[51] Int. Cl.[5] ..... A63C 9/00

[52] U.S. Cl. ..... 280/615; 280/607; 280/632; 36/117

[58] Field of Search ..... 280/607, 609, 613, 614, 280/615, 631, 632, 11.31; 36/117, 120

[56] References Cited

U.S. PATENT DOCUMENTS

| | | | |
|---|---|---|---|
| 3,003,777 | 10/1961 | Hilding | 280/614 |
| 4,438,947 | 3/1984 | Cooper | 280/615 |
| 4,487,427 | 12/1984 | Salomon | 36/117 X |
| 4,533,154 | 8/1985 | Bernard et al. | 280/615 |
| 4,562,653 | 1/1986 | Salomon | 36/117 |
| 4,691,936 | 9/1987 | Nowak et al. | 280/615 |
| 4,925,206 | 5/1990 | Graillat | 280/607 X |
| 5,007,656 | 4/1991 | Girault et al. | 280/615 |

FOREIGN PATENT DOCUMENTS

| | | | |
|---|---|---|---|
| 0088673 | 9/1983 | European Pat. Off. | 280/615 |
| 0131234 | 1/1985 | European Pat. Off. | 280/615 |
| 2942806 | 9/1985 | Fed. Rep. of Germany . | |
| 8404928 | 1/1986 | Fed. Rep. of Germany . | |
| 863591 | 9/1986 | Fed. Rep. of Germany . | |
| 3738157 | 5/1988 | Fed. Rep. of Germany | 280/615 |
| 8802115 | 8/1988 | Fed. Rep. of Germany . | |
| 160685 | 2/1989 | Fed. Rep. of Germany . | |
| 160825 | 2/1989 | Fed. Rep. of Germany . | |
| 161957 | 7/1989 | Fed. Rep. of Germany . | |

OTHER PUBLICATIONS

Richter et al.: Bauelements der Feinmechanik, 9 Auflage 1964, VEB Verlag Technik Berlin, pp. 265, 266.

*Primary Examiner*—Charles A. Marmor
*Assistant Examiner*—Brian L. Johnson
*Attorney, Agent, or Firm*—Andrus, Sceales, Starke & Sawall

[57] ABSTRACT

A cross-country ski binding (1) for cross-country ski shoes (2) which includes a sole front end (9) having a member which complements and engages a member of the binding (1). A pivot axis member (8) extends transversely to the longitudinal direction of the shoe and approximately parallel with the outsole surface and the binding members includes a retaining hook (3) which partially encompass the pivot axis member (8) and defines a hinge therewith. The retaining hook is adapted to move between a closed position and a release position. An elastically deformable element (10) engages the front of the ski shoe for elastically restoring the shoe (2) from an upward pivotal position to a position approximately parallel with the ski. The retaining hook (3) is maintained in the release position by a locking member (4) which is actuated by stepping the shoe into the binding, and particularly the sole-integrated pivot axis (8) which engages and pivots the locking member to the unlocking position. The retaining hook (3) is then freely movable to its closed position in which is encompasses the sole-integrated pivot axis (8). A spring (21) is coupled by an actuating lever (22) to the hook to move the hook to the closed position.

19 Claims, 3 Drawing Sheets

1
12
18
19
23
13
32
5
7
14
33
27
10
6
3
17
22
21
4
29
30
15
16
31

1
23
29
32
7
27
20
33
10
3
17
22
21
12
13
30
5
14
4
15
16
19
18

CROSS-COUNTRY SKI BINDING HAVING A RELEASABLE RETAINING HOOK ASSEMBLY

BACKGROUND OF THE INVENTION

The invention is directed to a cross-country or touring ski binding. Such a ski binding, which also originated from the-applicant, has recently become available the market. It is being sold under the name ROTTEFELLER NNN-BC (BACKCOUNTRY). This binding is distinguished by a robust structure, good guiding properties and safe operation. Accordingly, it has been well received among users.

The present invention is based on the object of improving the known ski binding in such a way that both "steppingin" and "steppingout" into and out of the binding are facilitated. At the same time, the binding is intended to guarantee an ergonomic flow of motion, especially without excessive load on the toes of the cross-country skier while skiing.

SUMMARY OF THE INVENTION

In accordance with the invention, a cross-country or touring ski binding for a cross-country ski shoe includes a front end of sole having an engaging member which is constructed to engage a member of the binding and form an articulated pivotal coupling. The front end member forms a sole-integrated pivot axis which extends transversely to the longitudinal direction of the shoe and approximately parallel with the bottom surface of said shoe. The complementing engaged member of the binding includes a retaining hook which at least partially encompasses the pivot axis member and defines a hinge therewith for moving the ski between a raised pivoted position and a lowered position approximately parallel with the ski. The retaining hook is movable between a closed position and a release position. The binding includes an elastically deformable element elastically engaging the front end of the shoe and restoring the shoe from the raised pivoted position to the lowered position, the specified object is solved by a locking member which is secured to the binding body in the location of the shoe within the binding and in the lowered position. Step-in of the shoe into the binding actuates the locking member to hold the retaining member in the release position in which the retaining hook is freely movable to its closed position at least partially encompassing the sole-integrated pivot axis.

The design according to the invention permits stepping into the binding without manual operation of an opening mechanism. Also, when the binding has been opened to permit stepping out, the corresponding actuating element need not be kept in the open position until the stepping out operation has been completed. Rather, the engaging elements inherent in the binding are kept in open or release position, respectively, by the locking member in accordance with the invention Thereby convenient stepping-in and stepping-out into and from the binding is enabled. In this respect the design according to the invention represents a considerable improvement over the known ski binding according to EPA83 400 403.8, in which during stepping out from the binding the retaining member for fixing the ski boot must also be kept in the open position either manually or by means of the ski pole against the action of an elastically deformable element or flexor cooperating with the retaining member. Consequently, the ski is continually urged away during the stepping-out operation and the skier may easily lose his balance. Above all, stepping out of the binding after a fall poses a problem in connection with such binding designs; in unfavourable cases it may even become impossible to step out of the binding because the power required to open the retaining member cannot be applied. Moreover, in case of the last-mentioned design even stepping into the binding may be problematic, because the retaining member is continuously biased. It is necessary to apply a relatively high pressure so as to urge the retaining element against the mentioned biasing force while stepping into the binding.

Due to the fact that the locking element according to the invention cooperates on the one hand with the retaining member, i.e. a retaining hook, and on the other hand with the complementary engaging element provided on the ski boot, it is also possible to obtain an extremely compact and still highly reliable design as will be apparent, for instance, from the preferred embodiment thereof.

Also, the arrangement or position of the pivot axis integrated in the sole is particularly significant as regards an ergonomic flow of motion. In the conventional structures in which the bending zone or bending line is as far forward as possible, especially in front of the shoe cap, it has been found that during cross-country skiing the shoe is subjected to considerable deformation. This work of deformation requires energy which is consumed and therefore cannot be transferred to the ski and the snow. It is therefore important to reduce such work of deformation to minimum so that a maximum proportion of the energy expended by the cross-country skier may be converted to speed. With the known system, the mentioned deformations occur predominantly in the toe area, especially also in the shoe upper part, and consequently at the termination of the rolling phase the toes are squeezed between outsole and shoe upper part, resulting in blue toenails after skiing over a major distance. The mentioned deformations also affect exact guiding of the ski because of the lack of a precise contact between foot and ski. Finally, the necessary work of deformation also results in premature tiredness of the feet. Moreover, when the bending line is in a relatively forward position, the ski contact is also affected. Experiments have shown that the mentioned drawbacks can be considerably reduced and even completely eliminated to a great extent by displacing the sole-integrated engaging elements, i.e. the pivot axis in this case, towards the rear. Above all, it has been found that, when the engaging elements which are part of the sole are designed as a sole-integrated pivot axis, optimum biomechanical results will be achieved when the soleintegrated pivot axis and hence the "binding pivot" are in the vicinity of the big toe of the cross-country skier.

BRIEF DESCRIPTION OF THE DRAWINGS

Below, an embodiment of the cross-country or touring ski binding according to the invention will be explained in detail with reference to the accompanying drawing, in which.

DESCRIPTION OF THE ILLUSTRATED EMBODIMENT

Figure 1:
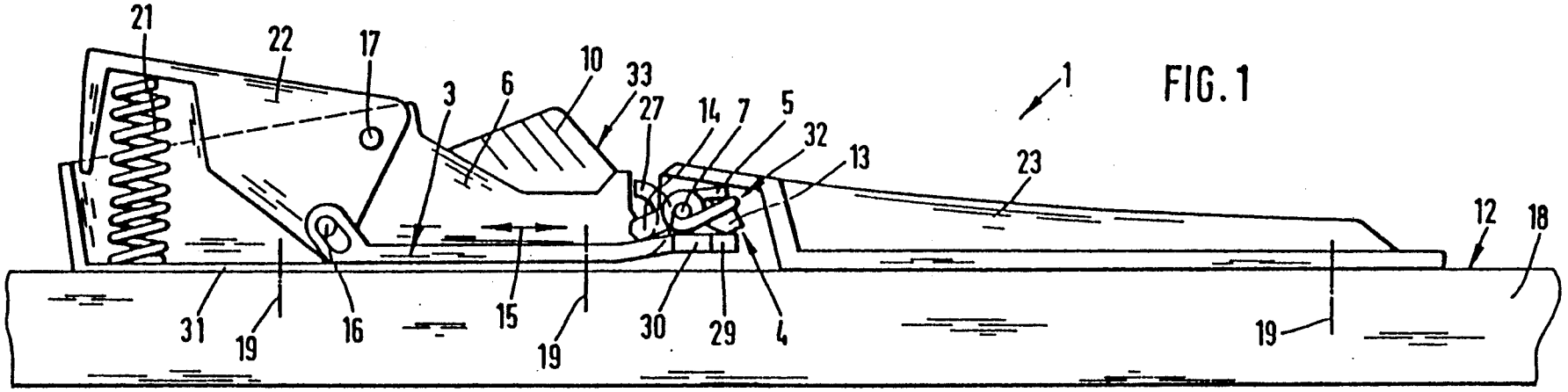
FIG. 1 is a schematic longitudinal section of a cross-country ski binding in accordance with the invention and illustrated in the closed position.
Figure 2:
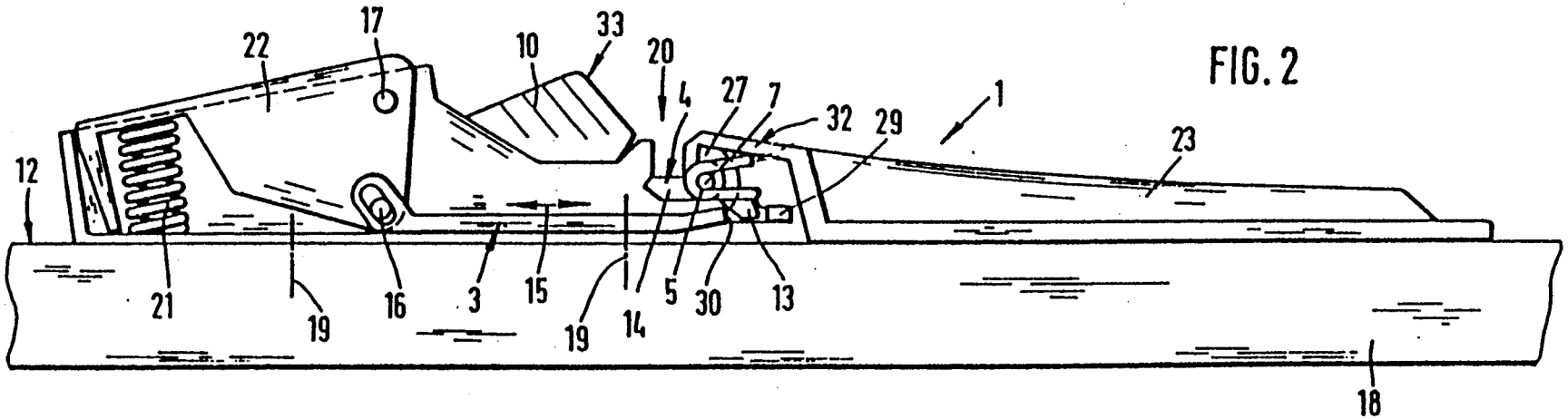
FIG. 2 is a schematic longitudinal section of the ski binding of FIG. 1 illustrated in the open or release position.
Figure 3:
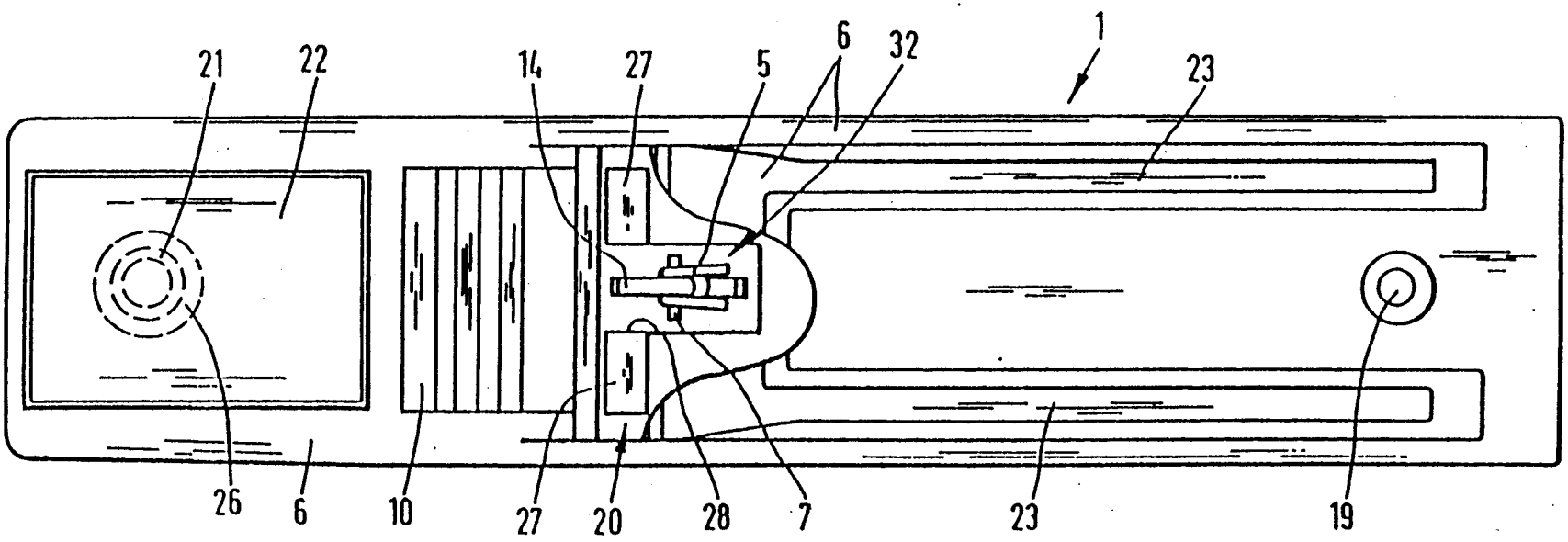
FIG. 3 is a plan view of the ski binding of FIG. 1 with a portion of an outer body portion broken away to show detail of the structure.
Figure 4:
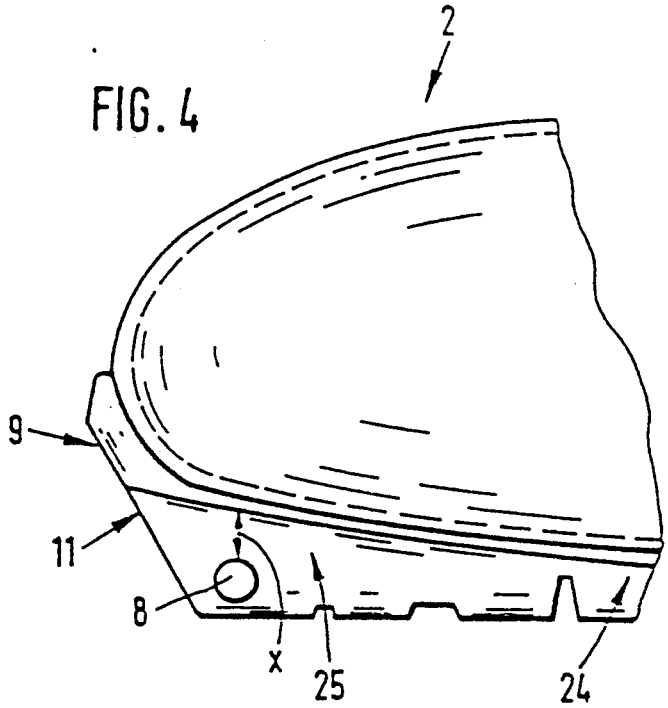
FIG. 4 is a longitudinal section of the front part of a ski shoe adapted to the binding shown in FIGS. 1 to 3.
Figure 5:
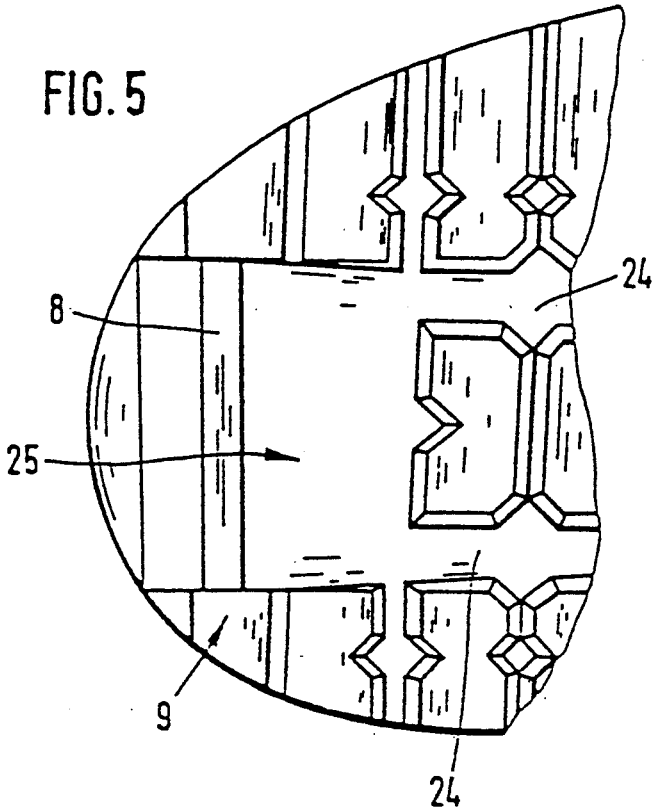
FIG. 5 is a bottom view of the outsole of the front part of the ski shoe of FIG. 4.

The ski binding illustrated in FIGS. 1 to 3 is a cross-country or touring ski binding 1 for cross-country ski shoes 2 which in accordance with FIGS. 4 and 5 respectively comprise at their sole front end 9 engaging elements for engagement with complementary engaging elements of the binding 1 so as to provide a coupling between binding 1 and ski shoe 2. The sole-integrated engagement elements comprise a pivot axis 8 which extends transversely to the longitudinal direction of the shoe and approximately parallel to the running surface of the sole. The complementary engagement elements of the binding 1 comprise a retaining hook 3 which partially encompasses the pivot axis 8 and together with the same forms a hinge, said retaining hook 3 being movable from a closing position shown in FIG. 1 to a release position shown in FIG. 2, and vice versa. On the side of the binding an elastically deformable member, viz. a flexor 10 for elastically returning the shoe 2 from its upwardly pivoted position to a position approximately parallel to the ski, cooperates with the sole front end 9. Supporting the ski shoe 2 by the flexor 10 is effected through a bevelled supporting face 11 on the sole front end 9. As illustrated in FIG. 2, the retaining hook 3 is kept in the release position by a locking member 4 in such a way that upon stepping into the binding the locking member 4 is adapted to be moved by the sole-integrated pivot axis 8 to a non-locking position shown in FIG. 1. In this position the retaining hook 3 moves to its closing position in which it encompasses the sole-integrated pivot axis 8, such movement being caused by a resilient element which will be described in detail below. The locking member 4 is urged into its locking position of FIG. 2 by a leg spring 5. Concretely, the locking member 4 is an articulated lever mounted for pivoting movement about a pivot axis 7 which extends transversely to the longitudinal direction of the ski and approximately parallel with the cover surface 12 of the ski, one leg 13 of said lever being engaged in the locking position with the retaining hook 3 such that said hook is kept in its releasing position, and the other leg 14 projecting into the path of movement of the sole-integrated pivot axis 8 when the skier steps into the binding 1. As already explained above, the retaining hook 3 is adapted to be moved to its releasing position against the action of a resilient element such as a helical compression spring 21. Said resilient element or helical compression spring 21 also causes the automatic movement of the retaining hook 3 to its closing position of FIG. 1 after unlocking by the locking member 4. As illustrated in FIGS. 1 and 2, the retaining hook 3 is pivotally mounted on a pivotally supported actuating lever 22 such that the pivoting movement of the actuating lever 22 can be converted to a translatory reciprocating movement of the retaining hook 3 (see the dual arrow 15). The pivotal mounting 16 of the retaining hook 3 to the actuating lever 22 is disposed, as illustrated in FIGS. 1 and 2, beneath the pivot axis 17 of the actuating lever 22 within the binding body 6, the actuating lever 22 being urged by the already mentioned helical compression spring 21 to a position in which the retaining hook 3 is disposed in its closing position shown in FIG. 1 in which it encompasses the sole-integrated pivot axis 8. Within the binding body 6, the flexor 10 as well as the retaining hook 3, the actuating lever 22 and the locking member 4 cooperating with the retaining hook 3 are mounted in the following order from front to rear or, respectively, from the ski tip towards the end of the ski: actuating lever 22, flexor 10, retaining hook 3 including the cooperating locking member 4. The binding body 6 is secured in a well-known manner to the cover surface of a ski body 18 by fastening screws 19.

The binding body 6 comprises an open-topped receiving groove 20 which extends transversely to the longitudinal direction of the ski and approximately parallel with the ski cover surface 12 for receiving the sole-integrated pivot axis 8, with said other leg 14 of the articulated lever which defines the locking member 4 for the retaining hook 3 encompassing the sole-integrated pivot axis 8 protruding into said groove.

As illustrated in FIGS. 1 to 3, the binding body 6 is extended in the direction towards the ski end by forming two guide ridges 23 for cooperation with complementary guide grooves 24 formed on the underside of the outsole of the ski shoe 2. The guide ridges 23 are integral parts of the binding body 6 which is preferably made from synthetic plastics.

As illustrated in FIGS. 4 and 5, the sole-integrated pivot axis 8 extends within a groove-like recess 25 formed on the underside of the front portion 9 of the outsole of the ski shoe 2 at a spacing "x" from the bottom of the groove-like recess 25. Furthermore it will be apparent from FIGS. 4 and 5 that the sole-integrated pivot axis 8 is set back relative to the forward end of the sole or, respectively, the forward supporting surface 11 at the front end of the sole so that it is approximately in the area of the big toe of a cross-country skier. In this way a particularly ergonomic flow of motion is obtained while cross-country skiing. The guide grooves 24 are contiguous with the recess 25 formed on the underside of the front portion 9 of the outsole. As shown in FIG. 4, the depth of the groove-like recess 25 and also of the guide grooves 24 contiguous therewith initially decreases progressively from the front end of the sole towards the rear or heel, respectively, and then remains approximately constant. Preferably, the depth of the groove-like recess 25 and the guide grooves 24 contiguous therewith progressively decreases approximately in the forward third of the overall length, i.e. approximately to the ball area of the ski shoe 2, as illustrated in FIG. 4. Thereafter, the depth of the remaining guide grooves 24 remains approximately constant, the guide grooves 24 being formed preferably only in the front part of the sole. However, they may also extend right to the heel of the shoe 2.

A hollow 26 for engagement by a ski pole tip is formed on the freely accessible top of the actuating lever 22.

As already indicated above, the retaining hook 3 is mounted in the binding body 6 for reciprocating movement in the direction of the dual arrow 15. In order to prevent jamming when the pivotal movement of the actuating lever 22 is converted to the translatory movement of the retaining hook 3, the pivot 16 or the corresponding coupling point of the retaining hook 3 with the actuating lever 22 is adapted to be radially displaceable relative to the pivot axis 17 of said lever, and in particular the pivot axis defining the coupling is guided for radial movement on the actuating lever 22.

In the illustrated embodiment, the retaining hook is defined by a flat element mounted in the binding body 6 for reciprocating movement, the one or rear end of said hook which faces towards the ski end is bent to define a U-shaped bow 27 which is open towards the tip of the ski and in the closing position encompasses the sole-integrated pivot axis 8, said bow 27 having an approximately central cut-out 28 in the vicinity of which the flat element is continued to define a protrusion 29 for cooperation with the locking member 4 in the locked position. The protrusion 29 is provided with an opening 30 for engagement therein in the locking position of said one leg 13 of the articulated lever which defines the locking member 4 (see FIG. 2). In the illustrated embodiment, the axis 7 of the articulated lever defining the locking member 4 is approximately in the vicinity of the geometrical axis of the U-shaped bow 27. Furthermore, the articulated lever defining the locking member 4 is bent to approximate V-shape towards the bottom 31 of the binding body 6 (see FIGS. 1 and 2).

Preferably, the flexor 10 is exchangeably disposed in the binding body 6 so that a softer or harder flexor may be inserted as required.

Also, it is possible to use an elastic block, for example of rubber material, instead of the helical compression spring 21 which is disposed between the actuating lever 22 and the bottom 31 of the binding body 6.

The receiving groove 20 for the pivot axis 8 is provided in an area between the flexor 10 and a roof-like body portion 32 which extends into the recess 25 on the underside of the front part of the sole of the ski shoe 2 so that the rolling motion of the shoe 2 while cross-country skiing is not impeded. In the open or release position of the retaining hook 3, the bow portion 27 thereof and the locking member 4 are covered by the roof-like body portion 32 except for the leg 14 projecting into the receiving groove and the leg spring 5 cooperating with the locking member. Also, the axis 7 about which the locking member 4 can be pivoted is disposed within the body portion 32. The leg spring 5 is placed about said axis 7 so that one leg bears against the inside of the body portion 32 and the other leg bears against the locking member in such a way that said locking member is urged towards the locking position in clockwise direction as seen in FIGS. 1 and 2.

The contour of the roof-like housing portion 32 and of the immediately contiguous guide ridges 23 both in longitudinal direction of the ski and also transversely thereof corresponds to the contour of the recess 25 and the immediately contiguous guide grooves 24 on the underside of the outsole of the ski shoe 2. In longitudinal direction of the ski, the contour of the mentioned portions is slightly concave as will be apparent from FIGS. 1 and 2. Due to this concavity, rolling of the outsole of the ski shoe 2 during cross-country skiing is promoted.

The aforementioned supporting surface 11 at the front end of the outsole of the ski shoe 2 bears against a corresponding inclined face 33 of the flexor 10 already when the ski shoe is completely lowered onto the ski cover surface 12 of the ski body 18. In this way the flexor 10 is effective from the very beginning when the ski shoe is swung up. The flexor 10 may be configured in such a way that the restoring force is either nearly constant or increases progressively over the entire compression distance.

The flat element defining the retaining hook is preferably made from stainless steel or aluminium. It is guided for longitudinal movement in the area between the coupling with the actuating lever 22 and the diametrically arranged bow portion 27 near the bottom 31 of the binding body 6.

Preferably, the locking member 4 is likewise made from stainless steel, in particular special steel, or aluminium. Basically, it would also be conceivable to make both the retaining member 3 and the locking member 4 from synthetic plastics, which also applies, for instance, to the actuating lever 22.

All of the features disclosed in these application papers are claimed as being essential to the invention to the extent to which they are novel either individually or in combination relative to the prior art.

We claim:

1. A cross-country or touring ski binding having a binding body and an engaging member, said body adapted to be secured to a ski for use with a cross-country ski shoe (2) including a sole having a front end (9) and an engaging element which complements and engages an engaging member of the binding body (1) and forms an articulated pivotal coupling, said engaged element forming a sole-integrated pivot axis (8) which extends transversely to the longitudinal direction of the shoe and approximately parallel with the bottom surface of said shoe, said engaging member includes a retaining hook (3) which at least partially encompasses said pivot axis (8) and defines a hinge therewith and permits moving the ski shoe between a raised pivoted position and a lowered position approximately parallel with the ski, said retaining hook being movable between a closed position and a release position, said binding having an elastically deformable element for elastically restoring the shoe (2) from said raised pivoted position to said lowered position, said deformable element operating with the front end (9) of the sole, the improvement comprising a locking member (4) secured to said binding body in a location of the shoe in said lowered position in said binding body, said locking member being movable between a locking position holding said retaining hook in said release position and an unlocking position permitting said retaining hook to move to said closed position and being movable by said engaged element whereby step-in of the shoe into the binding actuates said locking member to release said retaining hook and holds said locking member in said unlocking position in which the retaining hook (3) is freely movable to said sole integrated pivot axis (8).

2. The binding of claim 1, including an elastic element (5) coupled to said locking member (4) and urging said locking member into said locking position.

3. The binding of claim 1, wherein said locking member (4) includes an articulated lever having a pivot mount for pivotal movement about an axis (7) which extends transversely to the longitudinal direction of the ski and approximately parallel with the ski cover surface (12), said lever having a first leg engaging said retaining hook (3) in the locked position to hold said retaining hook in a released position, said lever having a second leg (14) engaged by said sole-integrated pivot axis (8) upon step-in of the shoe into the binding (1) and thereby moving said lever to permit said retaining hook to move to said closed position.

4. The binding of claim 1, having a resilient element adapted to be coupled to said retaining hook for moving said retaining hook to said closed portion, said resilient element being a helical compression spring (21), and means to move said hook (3) to said release position and to compress said spring to spring load said retaining hook to said closed position.

5. The binding of claim 1, including a pivotally mounted actuating lever (22) pivotally mounted on a pivot axis member (17) to said binding body and coupled to said retaining hook (3) by a means constructed and arranged to covert the pivoting movement of the actuating lever (22) to a translatory reciprocating movement of the retaining hook (3).

6. The binding of claim 5, wherein said retaining hook (3) includes a coupling connected to said actuating lever (22) below said pivot axis member (17), and a spring element (21) is coupled to said actuating lever (22) and said binding and urges said lever (22) towards a position in which the retaining hook (3) is placed in said closed position embracing said sole-integrated pivot axis (8).

7. The binding of claim 5, wherein said binding body includes a single binding body (6), means for connecting said retaining hook (3), said actuating lever (22) and said locking member (4) to said binding body (6), said body (6) being adapted to be mounted on the top surface (12) of the ski (18).

8. The binding of claim 7, wherein said binding body (6) includes an open-top receiving groove (20) extending transversely to the longitudinal direction of the ski and approximately parallel with the top surface (10) of the ski for receiving the sole-integrated pivot axis (8), said locking member (4) including a leg (14) mounted to engage said retaining hook (3) with said hook at least partially encompassing the sole-integrated pivot axis (8) and projecting into said receiving groove in the release position of said retaining hook (3).

9. The binding of claim 7, wherein said shoe includes a first guide member (24) on the bottom of the sole of the ski shoe, said binding body (6) having a second guide member (23) for cooperation with said first guide member (24) formed on the underside of the ski shoe (2), said first and second guide members including complementing ridge and grooves.

10. The binding of claim 1, wherein said ski shoe includes a groove-like recess (25) in the bottom of the sole, and said sole-integrated pivot axis (8) extends within said groove-like recess (25) at a selected spacing (x) from the bottom of the groove-like recess (25).

11. The binding of claim 10, wherein said sole-integrated pivot axis (8) is located slightly inwardly relative to the front end (9) of the shoe sole to locate the axis in the toe area of the shoe and sole.

12. The binding of claim 10 or 11, wherein said binding body extends rearwardly from the pivot axis (8) of the ski shoe, said binding body (6) having at least one guide member (23), said ski shoe having a contiguous guide groove (24) extending rearwardly from said groove-like recess (25) for mating engagement with said guide member (23), and wherein the depth of the groove-like recess (25) and the contiguous guide groove (24) on the and underside of the sole of the ski shoe (2) decreases progressively from the sole front end (9) towards the sole rear end and thereafter remains approximately constant.

13. The binding of claim 2, wherein the depth of the groove-like recess (25) and the contiguous guide groove (24) increases progressively approximately along a forward third of the overall length of the ski shoe and terminates in substantially the ball of the shoe.

14. The binding of claim 5, wherein said lever (22) includes a hollow portion (26) on a freely accessible top portion for engagement by a ski pole tip.

15. The binding of claim 5, wherein said actuating lever (22) has a pivot axis (17), aid hook having a coupling portion (16) pivotally connected to the actuating lever (22) in radial displacement from the pivot axis (17).

16. The binding of claim 1, wherein said retaining hook (3) includes a flat member mounted for reciprocating movement in the binding body (6), said flat member having a rearward end bent to form a U-shaped bow (27) opening toward the front of the binding body, said bow (27) in the closed portion of said retaining hook at least partially encompassing said sole-integrated pivot axis (8), said bow (27) having an approximately central cut-out portion (28) extending outwardly in the plane of the flat member to define a protrusion (29) engaged with the locking member (4) in the locking position.

17. The binding of claim 16, wherein said locking member includes a lever having a pivot axis (7) and having a first leg (13) and a second leg (14), said second leg being moved by said engaged element to pivot said lever and thereby said first leg and said protrusion (29) includes an opening (3) for engagement therein of said first leg (13) of said lever, said first leg (13) locking the retaining hook in position in the locking position of the lever.

18. The binding of claim 16, wherein said bow (27) has a geometrical axis, and said pivot axis (7) is substantially adjacent the geometrical axis of the U-shaped bow (27) in the release position of the retaining hook (3).

19. The binding of claim 9, wherein said legs of said lever define an approximate V-shape member opening towards a bottom (31) of the binding body (6).

* * * * *

UNITED STATES PATENT AND TRADEMARK OFFICE

CERTIFICATE OF CORRECTION

PATENT NO. : 5,190,310

DATED : March 2, 1993

INVENTOR(S) : BERNT-OTTO HAUGLIN ET AL

It is certified that error appears in the above-identified patent and that said Letters Patent is hereby corrected as shown below:

Claim 12, col. 8, line 9, delete "the and" and substitute therefor ---an---; Claim 15, col. 8, line 22, delete "aid" and substitute therefor ---said---.

Signed and Sealed this

Twenty-second Day of March, 1994

Attest:

Bruce Lehman

BRUCE LEHMAN

Attesting Officer

Commissioner of Patents and Trademarks